United States Patent [19]

Pardini

[11] Patent Number: 5,047,603

[45] Date of Patent: Sep. 10, 1991

[54] ELECTRICAL CONTACT STRUCTURES SPECIFICALLY SUITED FOR LOW POWER CIRCUITS

[75] Inventor: Franco P. Pardini, Milan, Italy

[73] Assignee: CGE Compagnia Generale Elettromeccanica S.p.A., Milan, Italy

[21] Appl. No.: 371,932

[22] Filed: Jun. 27, 1989

[30] Foreign Application Priority Data

Jun. 27, 1988 [IT] Italy ..... 21108 A/88

[51] Int. Cl.[5] ..... H01H 1/60

[52] U.S. Cl. ..... 200/253; 200/242; 200/531; 200/547; 200/549

[58] Field of Search ..... 200/241, 242, 243, 252, 200/253, 531, 536, 547, 549, 550, 257, 260

[56] References Cited

U.S. PATENT DOCUMENTS

| | | | |
|---|---|---|---|
| Re. 27,406 | 6/1972 | Cork | 200/242 |
| 3,230,334 | 1/1966 | Piber | 200/242 |
| 3,539,749 | 11/1970 | MacPheat | 200/242 |
| 3,818,169 | 6/1974 | Kobernus | 200/531 |
| 3,860,775 | 1/1975 | Koepke | 200/253 |
| 3,946,181 | 3/1976 | Takamizawa et al. | 200/531 |
| 4,137,440 | 1/1979 | Bryant | 200/260 |
| 4,147,908 | 4/1979 | Swann | 200/241 X |
| 4,277,662 | 7/1981 | Lewandowski | 200/242 |
| 4,634,819 | 1/1987 | Ikeda | 200/243 X |
| 4,650,435 | 3/1987 | Ootsuka et al. | 200/243 X |
| 4,789,764 | 12/1988 | Doros | 200/241 |
| 4,808,775 | 2/1989 | Satoh et al. | 200/241 |
| 4,839,475 | 6/1989 | Wilkinson et al. | 200/243 |

*Primary Examiner*—Henry J. Recla
*Assistant Examiner*—Glenn T. Barrett
*Attorney, Agent, or Firm*—Helfgott & Karas

[57] ABSTRACT

An electrical contact mechanism for low power circuits includes a pair of movable contacts which can be pressed against fixed contacts. The movable contacts are mounted on a conductive bridge which is movable by a slider. The motion of the movable contacts is imparted in two directions, of which one is parallel to a motion direction of the slider carrying the conductive bridge, and another direction is approximately perpendicular with respect to the first direction due to a wedging action between the movable and fixed contacts which are positioned obliquely to the direction of movement of the slider.

3 Claims, 3 Drawing Sheets

ELECTRICAL CONTACT STRUCTURES SPECIFICALLY SUITED FOR LOW POWER CIRCUITS

BACKGROUND OF THE INVENTION

The present invention relates to electrical contact structures particularly usable in low power circuits, expecially used as an interface between electromechanical devices and electronic circuits.

Owing to the higher and higher diffusion and to the cheaper and cheaper costs of semiconductor devices and systems and, in particular, of microprocessors in fields once almost completely covered by the electromechanics, it is more and more present the problem of interfacing electromechanical devices with electronic devices and, while the interfacing from electronic devices to electromechanical devices is usefully obtained through the use of amplifiers (buffers) providing high enough power to directly drive the electromechanical devices, the reverse interface from electromechanical devices to electronic devices suffers from easily predictable problems.

It should seem obvious in producing digital signals to be inputted in electronic devices, to use the theoretical digital features of a pair of electromechanical contacts whose opening and closure could exactly correspond to logical states "0" and "1", or vice versa according to the case. However, the electromechanical contacts, when used in particularly low power circuits, as for example with supply voltages lower than 10 volts and currents lower than 1 milliampere, can introduce problems in the faithful correspondence between opening and closure of said contacts and the associated logical states. These problems occur chiefly from the fact, that the surfaces of electromechanical contacts are never completely free from scales (specifically metal oxide and sulfide scales) or at any rate from extraneous non conductive matters which can unduly raise the contact resistance simulating a contact opening instead of a contact closure.

In circuits, having power higher than that of the electronic circuits, such as those used in the electromechanical field (as for example circuits containing low inductive loads such as microrelays), such a situation tends to disappear because, owing to the involved voltages and currents which are easily formed from rebounds after the closure of a contact pair.

To obviate the problem of poor correspondence between opening and closure states of contacts and associated logical states, there have been offered many different approaches.

A first approach consists in coating contact pads with noble metals (gold) with substantial cost raises and poor efficiency with respect to pollution from extraneous matters.

A second approach consists in using refractory metal coated contacts on resilient arms enclosed in electrically insulating bulbs (such as glass) in which an inert gas is enclosed (they are the well known "dry reed" contacts) assuring an excellent correspondence between opening and closure states and logical states, but they have the drawback of high cost, limited useful embodibility in just some specifical relays, substantial current limitation not permitting loads also just a little higher than the rated ones, under penalty of contact and contact arm over heating, and too high, sensitiveness to electromagnetic interferences and to accelerations or generally to mechanical shocks.

A third approach consists in employing usual contacts in free air whose number is multiplied to increase the number of connecting points, such as two movable contact pairs on two movable bridges, in parallel or two movable contact pairs on crossed bridges.

This approach, while is not very simple and inexpensive, does not obviate the problem of the poor correspondence between opening and closure states and logical states, because it can always happen that a heavy enough scale make the contact substantially insulated.

A fourth approach provides movable contacts mounted in pairs on a conductive bridge with the bridge providing, further to the approaching movement to a fixed contact pair, also a lateral or cross movement, once the contacts are in touch, for wiping and scraping the movable contacts against said fixed contacts in order to clean the mutually faced surfaces of said contacts.

This system can work for what regards the contact surface cleaning from metal oxides and sulfides, but has the drawback that, having the conductive bridge to slide on insulating material portions of a driving mechanism, wears away said insulating material, producing contact soiling by said material.

A further approach consists in using movable contact pairs, having substantially hemispherical shape, fastened to a conductive bridge, pressing on a fixed contact pair indexed according to a sloping plane with respect to the tangential point of said movable contacts, so that the movable contacts are compelled to accomplish a very limited rotation when engage the fixed contacts, but having to concurrently slide on insulating material portions, wear them and produce soiling of the contacts by the insulating material itself.

This drawback of contact soiling by worn insulating material could be avoided using movable contact arms resiliently strained, which, however have the drawback of poor reliability because, if an overcurrent flows through the resilient arms, it may happen that they are annealed by overheating due to overcurrent, losing their resilience and thus the feature of making the movable contacts wiping or rubbing against the fixed contacts.

SUMMARY OF THE INVENTION

It is an object of the present invention to provide an electric contact structure which is selfcleaning due to reciprocal wiping, particularly suited for low power circuits, which does not suffer from the drawbacks of the prior art structures leading to wear of insulating material portions but has permament strain of movable contact arms.

In order to avoid the above mentioned drawbacks it needs to eliminate any rubbing of conductive bridges with insulating portions of drivers and avoid any current flow through resilient means.

The above mentioned objects are obtained by an electric contact structure, in which at least a pair of movable contacts, connected by at least a conductive bridge, are moved in a first direction till the movable contacts engage at least a pair of fixed contacts and then continuing to wipe and rub on the fixed contact pair in the same first movement direction, produce the cleaning of the faced surfaces of the contacts, said conductive bridge being movable with respect to means causing its movement without rubbing on the same and resilient means cause the engagement of the movable contacts with the fixed contacts, said resilient means being excluded from current flow there through to avoid any possible annealing caused by overheating.

According to a first embodiment of the contact structure of the present invention, the movable contact pair are connected by a conductive bridge of the kind of a loop bent strap having two legs carrying at the ends the movable contacts and fastened at the middle to a slider movable within an insulating fixed frame supporting two clamps provided with fixed arms carrying respective fixed contacts, said movable contacts, which are carried to engage the fixed contacts rubbing against the fixed contacts and being thereafter pushed against the fixed contacts by resilient or spring means abutting against the ends of said conductive bridge through an insulating support allowing the engagement of said movable contacts with said fixed contacts without allowing a current to flow through said resilient means.

More particularly, a contact structure according the first embodiment, is of the normally open kind with the loop bent conductive bridge fastened to the slider at the top of the loop faced to the inside of the insulating fixed frame with the movable contacts held free from the fixed contacts when said slider is released, and the movable contacts are engaged against the fixed contacts when said slider is in the driven state, the passage of the movable contacts from the disenganged to the engaged state with the fixed contacts forcing said movable contacts to rub against said fixed contacts to clean their surface.

More particularly, a contact structure may be of the normally closed kind with the loop bent conductive bridge fastened to the slider at the top of the loop faced to the outside of the insulating fixed frame with the movable contacts held engaged with the fixed contacts when said slider is released, and the movable contacts disengaged from the fixed contacts when said slider is in the driven state, the passage of the movable contacts from the disengaged state to the engaged state with the fixed contacts making said movable contacts to rub against said fixed contacts to clean their surface.

According to a second embodiment of the contact structure, the movable contact pair are connected by a conductive bridge of the kind of a planar U shaped blade carrying at the external ends of its legs hinges pivotable about pins fastened to a slider movable within an insulating fixed frame supporting on a bracket fixed arms carrying fixed contacts respectively. The two movable contacts which are compelled to engage the fixed contacts, rub against said fixed contacts and remain pushed against them by resilient means abutting with one side against said conductive bridge and with the other side against protrusions carried by said slider, so that no current can flow through said resilient means.

More particularly a contact structure according to the second embodiment is of the normally open kind with the conductive bridge fastened to the slider at the end hinges faced to said fixed frame, with the movable contacts disengaged from the fixed contacts when said slider is released, and the movable contacts engaged with the fixed contacts when said slider is in an attracted or driven state. The passage of the movable contacts from the disengaged state the to the engaged state with the fixed contacts, enables said movable contacts to rub against said fixed contacts to clean their surfaces.

A contact structure according to the second embodiment may be of the normally closed kind just by constructing said slider so that the normally open function is changed to a normally closed function.

The features and the advantages of present invention will be made more apparent by the following detailed description of embodiments, not to be meant as limiting provided with the enclosed drawings.

DETAILED DESCRIPTION OF THE PREFERRED EMBODIMENTS

Figure 1:
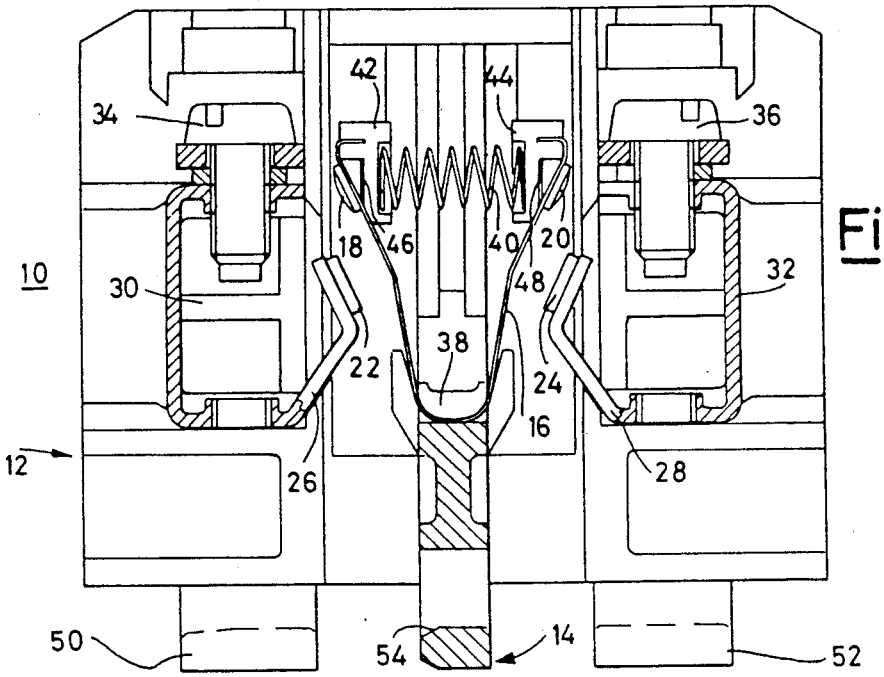
FIG. 1 is a side view in cross section of a first embodiment of the present invention, specifically usable in auxiliary contact blocks for contactors or relays or in a block driven by push buttons or similar, of the normally open kind, in the open position.
Figure 2:
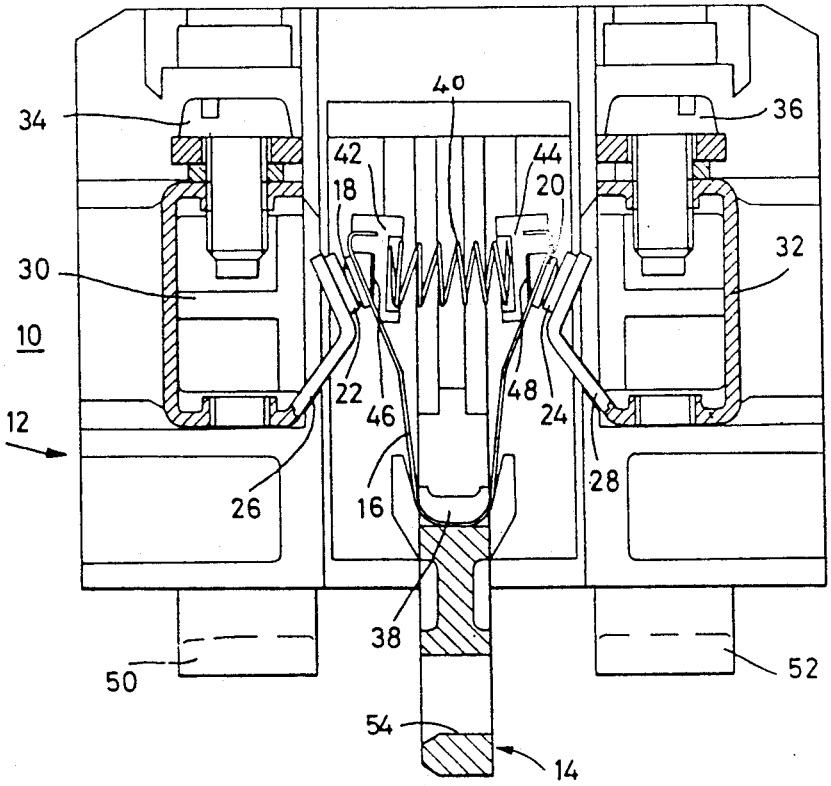
FIG. 2 is a side view of the structure of FIG. 1, in the closed position.

Reference is made to the first embodiment of the contact structure of the normally open kind depicted in FIGS. 1 and 2.

The contact structure 10 comprises an insulating support frame 12 and a movable slider 14 carrying on a conductive bridge 16 two movable contacts 18 and 20 adapted to engage two fixed contacts 22 and 24 fastened to contact arms 26 and 28, respectively, connected to clamps 30 and 32, respectively provided with screws 34 and 36 for fastening external connecting conductive straps (not shown).

The conductive bridge 16, comprised of a resilient enough conductive material is fastened by suitable supporting means 38 to the slider 14 and the ends carrying the movable contacts 18 and 20, are spaced apart by a compressing spring 40 abutting against said two ends through two insulating supports 42 and 44, respectively. Supports 42,44 are engaged against the ends of bridge 16 by fins 46 and 48 integrally formed with the conductive bridge 16. Fins 46 and 48 form stopping means of the bridge 16 against proper protrusions of the slider 14, being the ends of the bridge pushed by the compressing spring 40.

The contact structure 10 having the design of a contact block (specifically an auxiliary contact block of contactors or relays), is provided with latching fingers 50 and 52 for the fixed frame 12 and a latching finger 54 for the movable slider 14 allowing to mechanically connect the contact structure 10 to a device for operating the structure as an auxiliary contact block for said device.

Figure 3:
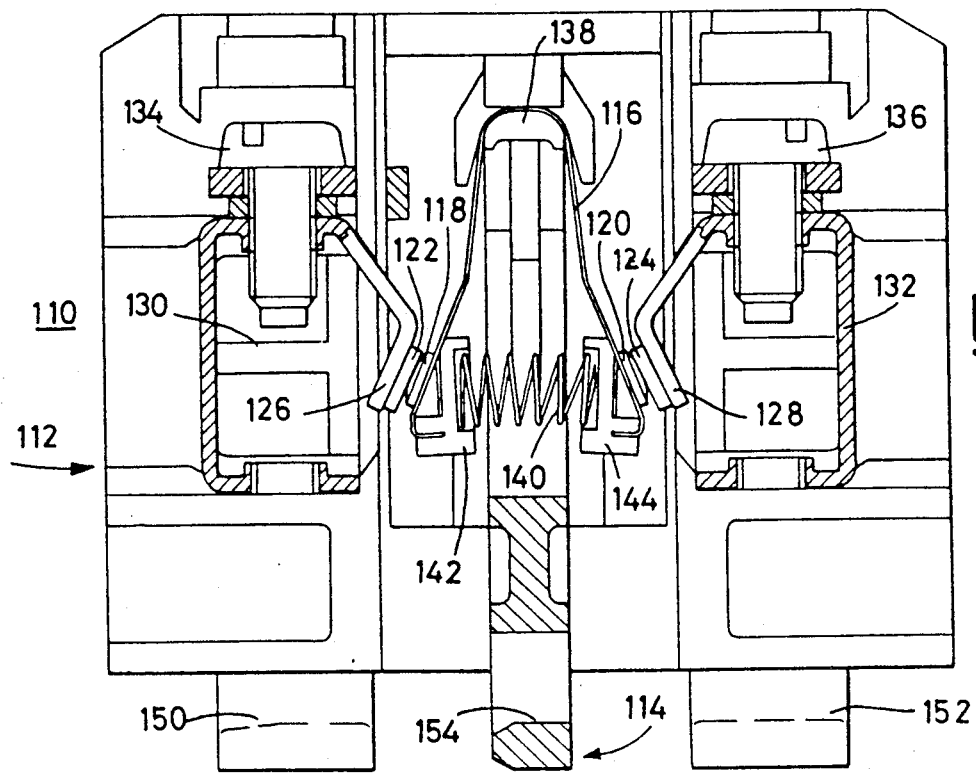
FIG. 3 is a side view in cross section of the first embodiment of the present invention, of the normally closed kind, in the closed position.
Figure 4:
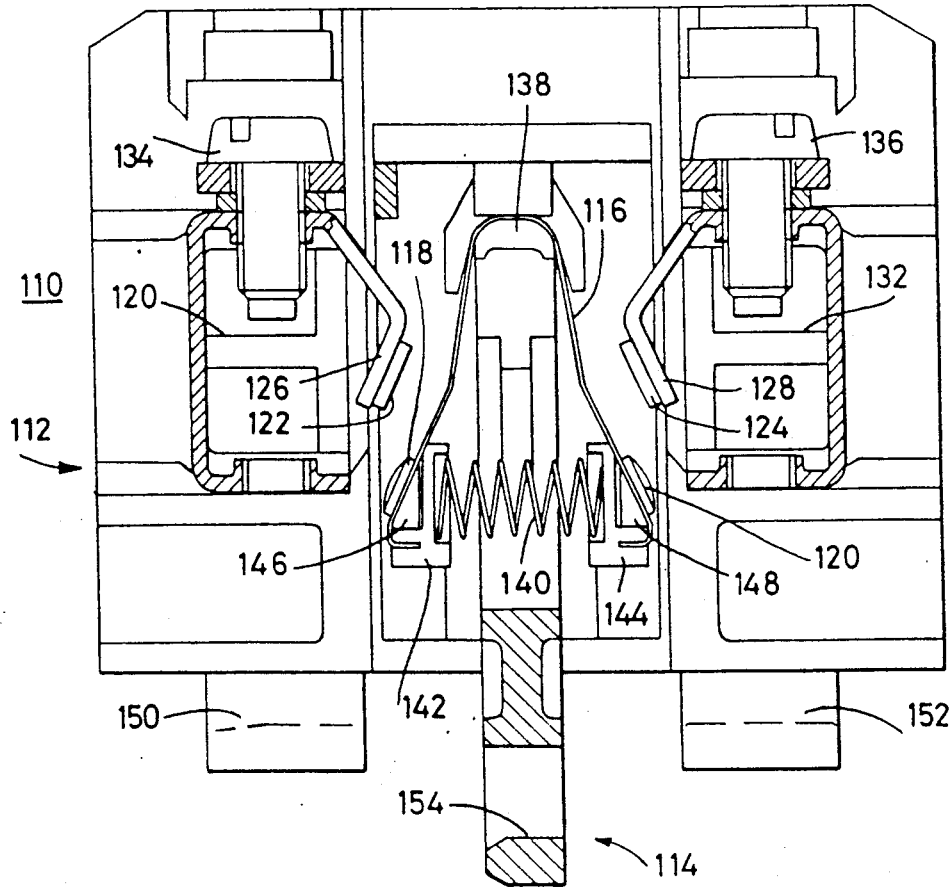
FIG. 4 is a side view in cross section of the structure of FIG. 3, in the open position.

Reference is now made to the first embodiment of the contact structure of the normally closed kind, depicted in FIGS. 3 and 4.

The contact structure 110 comprises a fixed supporting frame 112 and a movable slider 114 carrying on a conductive bridge 116 two movable contacts 118 and 120 engageable with two fixed contacts 122 and 124 fastened to contact arms 126 and 128, respectively, connected to clamps 130 and 132, respectively, provided with screws 134 and 136 for fastening external conductive connecting straps (not shown).

The conductive bridge 116, formed of a resilient enough conductive material, is fastened through proper fastening means 138 to the slider 114 and the ends thereof, carrying the movable contacts 118 and 120 are spaced apart by a compressive spring 140 abutting on said two ends by elements 142 and 144, respectively which are engaged with said ends of the bridge 116 by fins 146 and 148 integrally formed with the conductive bridge 116, said fins 146 and 148 forming the stopping means of the ends of the bridge 116 against proper protrusions of the slider 114, being the ends of the bridge 116 pushed by the compressing spring 140.

The contact structure 110, having the design of a contact block (specifically an auxiliary contact block for a relay), is provided with latching fingers 150 and 152 for the fixed frame 112 and a latching finger 154 for the movable slider 114, allowing to mechanically connect the contact structure 110 to a device for operating the structure as an auxiliary contact block for said device.

Reference is now made, to the second embodiment of the contact structure, of the normally open kind, depicted in FIGS. 5 to 8.

Figure 7:
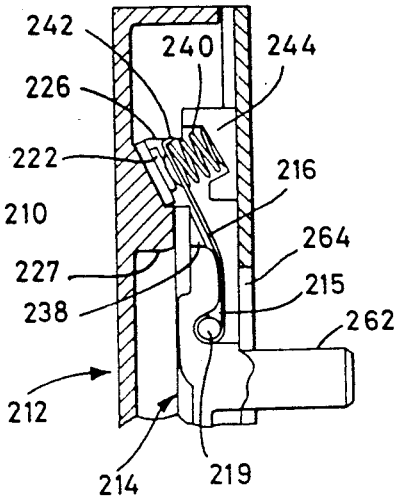
FIG. 7 is a side view in cross section of the second embodiment in the closed position.
Figure 8:
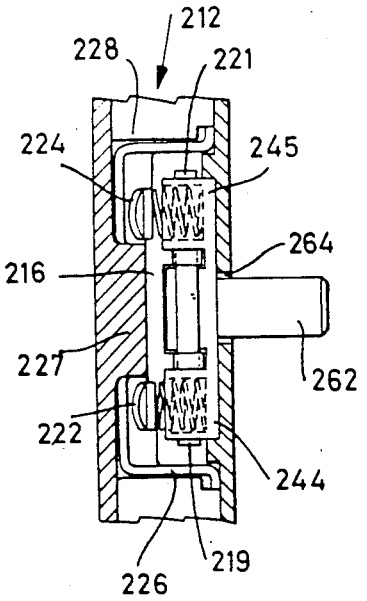
FIG. 8 is a top view in cross section of the second embodiment in the position depicted in FIG. 7.

The contact structure 210 comprises an insulating fixed support frame 212 and a movable slider 214 carrying on a conductive bridge 216, shaped as a U-shaped blade and pivotted by hinges 215 and 217 about pins 219 and 221 fastened to slider 214, two movable contacts 218 and 220 engageable with by two fixed contacts 222 and 224 which are fastened to contact arms 226 and 228, respectively fixed to an insulating support bracket 227 of from 212 and connectable to clamps (not shown) allowing the fastening of possible external conductive straps, or the like. The bridge 216, pivoted by the hinges 215 and 217 about pins 219 and 221 fastened to slider 214, carries on a transversal member the movable contacts 218 and 220 and, when the movable contacts are engaged with the fixed contacts 222 and 224, is held against stops 238 (only one stop is shown) integral with slider 214 by means of springs 240 and 241 abutting against protrusions 242 (only one protrusion is shown) the bridge 216 itself and against corresponding protrusions 244 and 245 integral with slider 214. When in the closed position the movable contacts 218 and 220 are engaged with the fixed contacts 222 and 224, as depicted in FIGS. 7 and 8, the bridge 216 is rotated in clockwise direction with the springs 240 and 241 pushing the movable contacts 218 and 220 against the fixed contacts 222 and 224.

Figure 5:
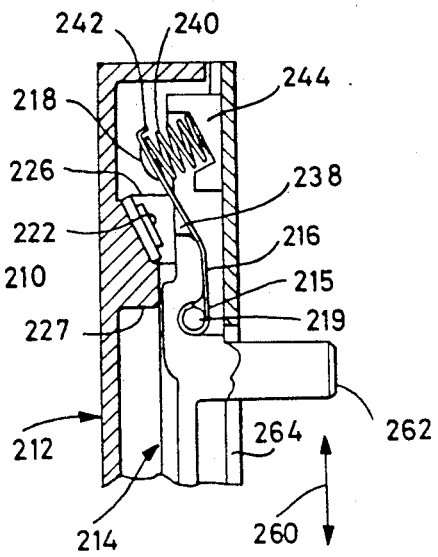
FIG. 5 is a schematical side view in cross section of a second embodiment of the contact structure of the present invention, specifically usable in lateral blocks for auxiliary contacts, of contactors or relays or in blocks for limit switches, of the normally open kind, in the open position.
Figure 6:
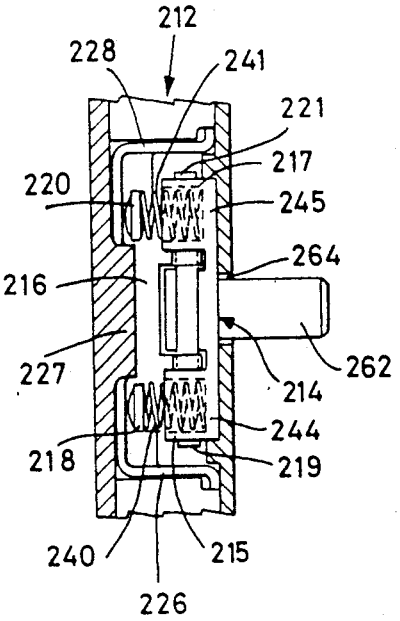
FIG. 6 is a top view in cross section of the second embodiment in the position depicted in FIG. 5.

When in the open position the movable contacts 218 and 220 are disengaged from the fixed contacts 222 and 224 (as depicted in FIGS. 5 and 6); the bridge 216 is rotated in counterclockwise direction pushed by the springs 240 and 241 to abut against the stops 238 on the slider 214.

The slider 214 is made movable, in the direction of arrow 260, by a finger 262 protruding through a window 264 formed in the fixed frame 212 toward external actuating means (not shown). The FIGS. 5 to 8 can also depict a normally closed-contact structure, considering the FIG. 5 condition as corresponding to an actuated device and the FIG. 7 condition as corresponding to a not actuated device.

The operation of the contact structures according to the present invention is herebelow described.

Referring to the first embodiment specifically usable in top blocks for auxiliary contacts in contactors and relays and in contact blocks driven by push-buttons or like, of normally open kind, depicted in the FIGS. 1 and 2, it is seen that in the open position of FIG. 1, the movable contacts 18 and 20 are disengaged from the fixed contacts 22 and 24, while in the closed position of FIG. 2 the movable contacts 18 and 20 are strongly abutting against the fixed contacts 22 and 24.

From the comparison of the two figures it is understood that the movable contacts passing from disengagement to engagement with the fixed contacts, rub against the latter thus cleaning their abuttings surfaces and thus assuring a good quality contact even in very low power conditions (i.e. for voltages lower than 10 volts and current lower than 1 mA) and in polluted environments.

The stroke of the slider 14 is so long that the movable contacts 18 and 20 rub on the whole extension of the fixed contacts 22 and 24 and the spring 40, under wedge action due to the slope of the fixed contacts 22 and 24, with respect to the axis of the slider 14, assures a contact force well higher than the force on the slider 14 coming from its stroke. Thus, without requiring from the actuating mechanisms exagerated forces, which could heavily affect the power of the electromagnets, it is possible to allow a particularly efficient and safe contact closure.

Referring to the first embodiment for normally closed contacts depicted in FIGS. 3 and 4, the operation in a reverse fashion with respect to the example depicted in FIGS. 1 and 2, results in that the cleaning of the movable contacts 118 and 120 against the fixed contacts 122 and 124 occurs at the time of the release or deactuation of slider 114 when it passes from the actuated to the released position. The rubbing mechanism and the pressure of the movable contacts 118 and 120 against the fixed contacts 122 and 124 are similar to those depicted in FIGS. 1 and 2 with the only difference that presently the contact closure by deactuation rather than by actuation of the slider 114.

Referring to the second embodiment particularly usable in slide blocks for auxiliary contacts of contactors relays or limit switches, of the normally open kind, depicted in the FIGS. 5 to 8, it is seen that in the open position of FIGS. 5 and 6, the movable contacts 218 and 220 are disengaged from the fixed contacts 222 and 224, while in the closed position of FIGS. 7 and 8, the movable contacts 218 and 220 are strongly abutting against the fixed contacts 222 and 224.

From the comparison of FIGS. 5 and 6 with FIGS. 7 and 8, it is understood that the movable contacts, in passing from disengagement to engagement with the fixed contacts, rub against the latter, cleaning each other surfaces and thus assuring a good quality contact even in condition of very low power (i.e. voltages lower then 10 volts and currents lower than 1 mA) or in a polluted environment.

The stroke of the slider 214 is so long that the movable contacts 218 and 220 rub along the whole extension of the fixed contacts 222 and 224, and the springs 240 and 241, under the wedging action due to the slope of the fixed contacts 222 and 224, with respect to the axis of the slider 214, provide a force between the contacts which is well higher than the operating force on the slider 214.

Thus, without requiring exagerated forces from the actuating mechanism, which would affect the power requirements of the used electromagnets, it is possible to provide a particular efficient and safe contact closure. Of course, there is a similar operation for a normally closed contact structure obtained by exchanging the structures of FIGS. 5 and 7, as already mentioned here above.

What have been here above depicted are preferred embodiments of the present invention and it will be obvious that those skilled in the art can devise, from the reading of the above description approaches, provisions and equivalent changements all to be considered here covered.

I claim:

1. Electric contact mechanism, particularly for use in low power circuits of double-interruption type, comprising:

insulating frame means;

at least one pair of fixed contacts having flat contact surfaces and provided on said frame means;

at least one pair of movable contacts having flat contact surfaces and cooperating with said fixed contacts to open or close a circuit;

at least one electrically conductive bridge carrying said movable contacts;

slider means for reciprocally moving said conductive bridge in a first direction to move said movable contacts into and out from engagement with said fixed contacts;

spring means acting on said conductive bridge to press said movable contacts against said fixed contacts in an engaged position thereof, said spring means being positioned such that they are excluded from a current flow therethrough to avoid a possible annealing thereof due to overheating;

said movable contacts being positioned on said conductive bridge so that when said movable contacts engage said fixed contacts, said movable contacts continue to move along said fixed contacts in a second direction, inclined to said first direction, in order to rub against said fixed contacts, thereby cleaning contact surfaces of said fixed and movable contacts;

said conductive bridge being a U-shaped strap, said slider means including an elongated slider movable within said frame means, said frame means having support brackets provided with fixed arms carrying said fixed contacts, said U-shaped strap having legs carrying at external ends thereof hinges, said slider having pins fastened thereto, said hinges being adapted to pivot about said pins, said spring means abutting at one end thereof against said conductive bridge and at another end thereof against protrusions carried by said slider so that no electric current can flow through said spring means.

2. Electric contact mechanism according to claim 1, which is of normally open type, wherein said conductive bridge is fastened to said slider at said hinges and said legs carrying at ends thereof said movable contacts are turned towards an interior of said frame means, said movable contacts being disengaged from said fixed contacts when said slider is released and engaged with said fixed contacts when said slider is actuated, and wherein during transition of said movable contacts from a disengaged position to the engaged position said movable contacts rub against said fixed contacts to clean the contact surfaces thereof.

3. Electric contact mechanism according to claim 1, wherein said movable contacts and said fixed contacts are arranged in parallel planes inclined to the axis of elongation of said slider.

* * * * *